US010857752B2

(12) United States Patent
Ponti

(10) Patent No.: US 10,857,752 B2
(45) Date of Patent: Dec. 8, 2020

(54) CUTTING STATION FOR MAKING TRANSVERSAL CUTS IN A CARDBOARD SHEET AND A MACHINE FOR PACKING AN ARTICLE INTERNALLY OF A CARDBOARD BOX OBTAINED FROM THE CARDBOARD SHEET

(71) Applicant: F.L. AUTO S.R.L., Rome (IT)

(72) Inventor: Giuseppe Ponti, Cerbara-Citta' di Castello (IT)

(73) Assignee: F.L. AUTO S.R.L., Rome (IT)

( * ) Notice: Subject to any disclaimer, the term of this patent is extended or adjusted under 35 U.S.C. 154(b) by 141 days.

(21) Appl. No.: 16/303,548

(22) PCT Filed: May 16, 2017

(86) PCT No.: PCT/IB2017/052874
§ 371 (c)(1),
(2) Date: Nov. 20, 2018

(87) PCT Pub. No.: WO2017/203391
PCT Pub. Date: Nov. 30, 2017

(65) Prior Publication Data

US 2020/0031083 A1 Jan. 30, 2020

(30) Foreign Application Priority Data

May 24, 2016 (IT) ..... 102016000053114

(51) Int. Cl.
*B31B 50/20* (2017.01)
*B31B 50/25* (2017.01)
*B65B 5/02* (2006.01)

(52) U.S. Cl.
CPC ..... *B31B 50/20* (2017.08); *B31B 50/25* (2017.08); *B65B 5/024* (2013.01)

(58) Field of Classification Search
CPC ..... B31B 50/25; B31B 50/20; B65B 5/024
(Continued)

(56) References Cited

U.S. PATENT DOCUMENTS 3,308,723 A * 3/1967 Bergh, Jr. ..... B31B 50/00 493/354
4,088,049 A * 5/1978 Benedict ..... B26D 1/18 83/240

(Continued)

FOREIGN PATENT DOCUMENTS

EP 1857235 A2 11/2007
GB 2295986 A 6/1996

(Continued)

*Primary Examiner* — Nathaniel C Chukwurah
*Assistant Examiner* — Lucas E. A. Palmer
(74) *Attorney, Agent, or Firm* — R. Neil Sudol; Henry D. Coleman

(57) ABSTRACT

A cardboard sheet is cut from a continuous cardboard strip unwound from a fanfold. A conveyor advances the strip along a conveyor plane and halts the strip for cutting. A first rotary circular blade mounted above the conveyor plane is movable in alternating translation transverse thereto and can pass through or beyond the conveyor plane to cut the continuous strip to obtain a cardboard sheet. A cutting profile of a toothed second rotary circular blade mounted above the conveyor plane contacts the continuous strip of cardboard without passing beyond it so as to realize thereon a transverse score line.

6 Claims, 10 Drawing Sheets

(58) Field of Classification Search
USPC ..... 493/59, 60
See application file for complete search history.

(56) References Cited

U.S. PATENT DOCUMENTS 4,640,222 A * 2/1987 Gerber ..... A41H 23/00 118/308
4,931,031 A * 6/1990 Lisiecki ..... B31F 7/006 493/340
5,624,369 A * 4/1997 Bidlack ..... B31B 50/00 493/342
5,888,183 A * 3/1999 Ruthenberg ..... B31F 1/10 493/160
5,964,686 A * 10/1999 Bidlack ..... B26D 1/185 493/160
6,245,004 B1 * 6/2001 Waters ..... B26F 1/3813 493/473
6,598,380 B1 * 7/2003 Sgubbi ..... B65B 5/024 53/251
9,969,142 B2 * 5/2018 Pettersson ..... B26D 1/185
2004/0082453 A1 * 4/2004 Pettersson ..... G05B 19/19 493/180
2004/0085422 A1 * 5/2004 Kelley ..... B41J 11/66 347/101
2012/0247642 A1 * 10/2012 Bartholomeusz ..... B26F 1/3806 156/64
2013/0045847 A1 * 2/2013 Capoia ..... B26D 7/2635 493/59
2015/0018189 A1 * 1/2015 Pettersson ..... B26D 1/185 493/370
2015/0224731 A1 * 8/2015 Ponti ..... B65B 57/12 493/59
2015/0360433 A1 12/2015 Feijen
2016/0136834 A1 * 5/2016 Veis ..... B26F 3/008 83/880
2018/0178480 A1 * 6/2018 Capoia ..... B26D 1/225

FOREIGN PATENT DOCUMENTS

WO WO 2010/029416 A2 3/2010
WO WO 2014/033635 A1 3/2014

* cited by examiner

CUTTING STATION FOR MAKING TRANSVERSAL CUTS IN A CARDBOARD SHEET AND A MACHINE FOR PACKING AN ARTICLE INTERNALLY OF A CARDBOARD BOX OBTAINED FROM THE CARDBOARD SHEET

FIELD OF THE INVENTION

The present invention relates to the particular technical sector concerning packaging and packing of articles internally of a cardboard box.

In particular the present invention relates to a cutting station of a cardboard sheet from a continuous strip of cardboard and a machine for packing an article internally of a cardboard box obtained from the cardboard sheet

DESCRIPTION OF THE PRIOR ART

In the sector of logistics and goods dispatching, the need to pack and package the goods to be dispatched is known, in relative cardboard boxes, with the purpose of protecting and safeguarding them.

The Applicant has realised a special cardboard box for packaging articles, usable for forming a cardboard box with reinforced walls for packing and packaging an article internally thereof, so as to give a special protection and resistance against impacts, and the Applicant also set up special operating procedures for obtaining and realising, from a cardboard sheet, on the basis of the effective dimensions of the article to be packed, the relative cardboard blank and enveloping it about the article so as to package it internally of a box.

The Applicant is the owner of Italian patent application no. 102015000014902 of May 13, 2015 in which the special shape of a cardboard blank for packaging utilisable for the packaging of articles is described.

The cardboard blank (C) for packing disclosed by this patent application, and illustrated in FIG. 1, is obtained from a cardboard sheet, for example undulated, which is cut from a continuous strip of cardboard and then subjected to scoring and cutting operations for achieving the special shape of the illustrated cardboard blank.

A possible sequence of operations with which the cardboard blank illustrated in FIG. 1 can be folded so as to realise a packaging box with a relative article internally thereof is illustrated in the sequence of FIGS. 1A-1F, and also described in the above-mentioned patent application belonging to the Applicant.

The cardboard blank (C) has a quadrilateral shape, which can be for example square or preferably rectangular, with two transversal edges (B1, B2) and two longitudinal edges (BL), and comprises, at a first transversal edge (B1) and a second transversal edge (B2), two longitudinal fold lines (L1, L2), parallel to one another: the two longitudinal score lines (L1, L2) identify, in the cardboard sheet, a central sector (SC) and two lateral sectors (SL1, SL2).

Usually, the articles to be packed and dispatched are either predisposed in containers having a parallelepiped shape, with a quadrangular or rectangular base.

The two longitudinal score lines (L1, L2) are realised on the cardboard blank (C) distanced from one another on the basis of the effective dimensions of the base of the article to be packed, for example on the basis of the length of the base of the article.

The cardboard blank (C) further comprises, in the central sector (SC), four transversal score lines (T1, T2, T3, T4), parallel to one another, which extends from the first (L1) to the second (L2) longitudinal score line, so as to identify, on the central sector (SC) of the cardboard blank (C) and between the two transversal edges (B1, B2), five portions (P1, P2, P3, P4, P5).

The four transversal score lines (T1, T2, T3, T4)) are made so as to be distanced from one another as a function of the effective dimensions of the article to be packed, in particular on the basis of the width of the base of the article, the width (L*) of the upper face and the height (H) of the flanks of the article.

In detail, starting from a first transversal edge (B1) of the cardboard blank (C);

- the first transversal score line (T1) and the second transversal score line (T2) are realised so as to be distant from one another by a distance (I) corresponding to the width of the base of the article to be packed, in this way, in the central sector (SC) of the cardboard blank (C) a first portion (P1) is identified that has dimensions corresponding to the base of the article to be packed, and on which first portion (P1) the article can be rested during the packaging operations;
- the first transversal score line (T1) is realised at a distance from the first transversal edge (B1) of the cardboard blank (C) such that it corresponds to the height (H) of a first lateral flank of the article, and in this way, in the central sector (SC) of the cardboard box (C) a second portion (P2) is identified between the first transversal edge (B1) and the first portion (P1), of dimensions corresponding to a first lateral flank of the article to be packed, and destined to cover the first flank of the article during the packaging operations once folded about the first transversal score line (T1);
- the third transversal score line (T3) is realised so as to be distant from the second transversal score line (T2) by a distance corresponding to the height (H) of a second flank of the article, parallel and opposite the first flank; in this way, in the central sector (SC) of the cardboard blank (C) a third portion (P3) is defined, adjacent to the first portion (P1) and on the opposite side to the second portion (P2), having dimensions corresponding to the second lateral flank of the article to be packed, and destined to cover the second flank during the packaging operations once folded about the second transversal score line (T2);
- the fourth transversal score line (T4) is realised so as to be distant from the third transversal score line (T3) by a distance corresponding to the width (L*) of the upper face of the article to be packed, in this way, in the central sector (SC) of the cardboard blank (C), a fourth portion (P4) is defined, adjacent to the third portion (P3), having dimensions corresponding to the upper face of the article to be packed, and destined to cover the upper flank once the third portion (P3) has been folded about the second transversal score line (T2) in order to cover the second flank of the article and the fourth portion (P4) has been folded about the third transversal score line (T3).

The cardboard blank (C) further comprises, again in the central sector (SC), a fifth portion (P5) which projects from the second transversal edge (B2), adjacent to the fourth portion (P4) and hinged thereto by means of the fourth transversal score line (T4), which constitutes a closing/opening tab (AC) that is destined to be glued to the second portion (P2) of the cardboard blank (C), once the second portion (P2) folded to envelop the first flank of the article and the third (P3) and the fourth portion (P4) have been folded respectively to envelop the second flank of the article and the upper face of the article, and to constitute a gripping tab for the user for opening the box.

The cardboard blank (C) further comprises, for each of the two lateral sectors (SL1, SL2), three transversal cuts (I1, I2, I3) which extend from the longitudinal edges (BL) of the cardboard blank up to arriving at the two longitudinal score lines (L1, L2), and are made at the first three transversal score lines (T1, T2, T3).

In this way, in the two lateral sectors (SL1, SL2) of the cardboard blank, the cardboard blank (C) comprises:

between the first transversal edge (B1) of the cardboard blank (C) and the transversal cuts (I1) made at the first transversal score line (T1), a first reinforcing flap (R1), at a first end of the second portion (P2), foldable on the second portion (P2) about the first longitudinal score line (L1),—and a second reinforcing flap (R2) at a second end of the second portion (P2) and foldable on the second portion (P2) about the second longitudinal score line (L2) so as to at least partly superpose on the first reinforcing flap (R1): the second portion (P2) with the first (R1) and second reinforcing flap (R2) folded thereon and at least partly superposed, constitutes a first lateral closing wall (C1) which is foldable about the first transversal score line (T1) for covering the first lateral flank of the article to be packed (see FIGS. 1A, 1B);

between the second transversal cuts (I2) and the third transversal cuts (I3), a third reinforcing flap (R3) at a first end of the third portion (P3), foldable on the third portion (P3) about the first longitudinal score line (L1), and a fourth reinforcing flap (R4) at a second end of the third portion (P3) and foldable on the third portion (P3) about the second longitudinal score line (L2) so as to at least partly superpose on the third reinforcing flap (R3): the third portion (P3) with the third (R3) and fourth (R4) reinforcing flap folded thereon and at least partly superposed, constitutes a second lateral closing wall (C2) which foldable about the second transversal score line (T2) for covering the second lateral flank, opposite the first flank, of the article to be packed (see FIGS. 1B, 1C);

between the first transversal cuts (I1) and the second transversal cuts (I2), a first lateral enveloping flap (A1) at a first end of the first portion (P1), foldable about the first longitudinal score line (L1) for covering and enveloping a third lateral flank of the article to be packed, and a second lateral enveloping flap (A2), at a second end of the first portion (P1), foldable about the second longitudinal score line (L2) for covering and enveloping the fourth flank, opposite the third flank, of the article to be packed (see FIGS. 1A, 1B);

between the third cuts (I3) and the second transversal edge (B2) of the cardboard sheet, a fifth reinforcing flap (R5), at a first end of the fourth portion (P4), foldable on the fourth portion (P4) about the first longitudinal score line (L1),—and a sixth reinforcing flap (R6) at a second end of the fourth portion (P4) and foldable on the fourth portion (P4) about the second longitudinal score line (L2) so as to at least partly superpose on the fifth reinforcing flap (R5): the fourth portion (P4) with the fifth (R5) and sixth (R6) reinforcing flap folded thereon and at least partly superposed, constitutes an upper closing wall (PS) which is foldable about the third transversal score line (T3), once the second lateral closing wall (C2) has been folded about the second transversal score line (T2) for covering the second lateral flank, for covering the upper face of the article to be packed (see FIGS. 1A, 1F).

The first lateral enveloping flap (A1) comprises a pair of longitudinal fold lines (a, b) parallel and realised at a distance such that on the first flap (A1), between the two fold lines (a, b), a third lateral closing wall (C3) is identified, having a height corresponding to the height of a third lateral flank of the article to be packed, and also a first folding tab (a1), between the third lateral closing wall (C3) and the first score line (L1), and a second folding tab (a2), between the third lateral closing wall (C3) and the longitudinal edge (BL) of the cardboard box (C) are identified.

The first folding tab (a1) is destined to superpose on a part of the first portion (P1) once it has been rotated with respect to the first longitudinal score line (L1), so as to form a reinforcing edge, while the second folding tab (a2) is destined, once the third lateral closing wall (C3) has been folded with respect to the first folding tab (a1) for covering the third flank of the article, to be folded with respect to the third lateral closing wall (C3) for covering a portion of the upper face of the article, before the face is covered by the upper closing wall (PS).

Correspondingly, the second lateral enveloping flap (A2) comprises a pair of parallel longitudinal score lines (c, d) parallel and realised at a distance such that on the second flap (A2), between the two fold lines (a, b), a fourth lateral closing wall (C4) is identified, having a height corresponding to the height of a fourth lateral flank of the article to be packed, opposite the third flank, and also a third folding tab (a3), between the fourth lateral closing wall (C4) and the second score line (L2), and a fourth folding tab (a4), between the fourth lateral closing wall (C4) and the second longitudinal edge (BL) of the cardboard box (C) are identified.

The third folding tab (a3) is destined to superpose on a part of the first portion (P1) once it has been rotated with respect to the second longitudinal score line (L1), so as to form a reinforcing edge, while the fourth folding tab (a4) is destined, once the fourth lateral closing wall (C4) has been folded with respect to the third folding tab (a3) for covering the fourth flank of the article, to be folded with respect to the fourth lateral closing wall (C4) for covering a portion of the upper face of the article, before the face is covered by the upper closing wall (PS) (see FIGS. 1C-1F).

SUMMARY OF THE INVENTION

The present invention has the aim of providing a cutting station for cutting a cardboard sheet from a continuous strip of cardboard stored in a fanfold, i.e. from a continuous strip of corrugated cardboard that is folded on itself many times, in a sort of bellows-fashion, to form a column, which cardboard sheet must be worked so as to obtain the cardboard blank designed by the Applicant, as described in the preamble and used for packaging an article.

The cited aim is obtained with a cutting station according to claim 1.

The present invention also has the aim of providing a machine for obtaining the cardboard blank described in the foregoing, starting from a continuous strip of cardboard stored in a fanfold, and for carrying out all the operations necessary for carrying out the packaging of an article internally of a box obtained from the cardboard.

The objective of the invention is to provide a machine able to carry out all the operations necessary for completing the packaging of the article very rapidly and efficiently, with the aim of guaranteeing high productivity in terms of numbers of articles packaged per hour, up to even 1000 articles packaged per hour.

This last aim is obtained by a machine for packing an article internally of a cardboard box obtained from a cardboard blank as described in the preamble, according to claim 7.

BRIEF DESCRIPTION OF THE DRAWINGS

The characteristics of a preferred embodiment of a cutting station of a cardboard sheet starting from a continuous strip of cardboard, and a machine for packaging an article internally of a cardboard box obtained from the cardboard sheet, of the present invention, will be described in the following with reference to the appended tables of drawings, in which.

DESCRIPTION OF THE PREFERRED EMBODIMENTS

Figure 1:
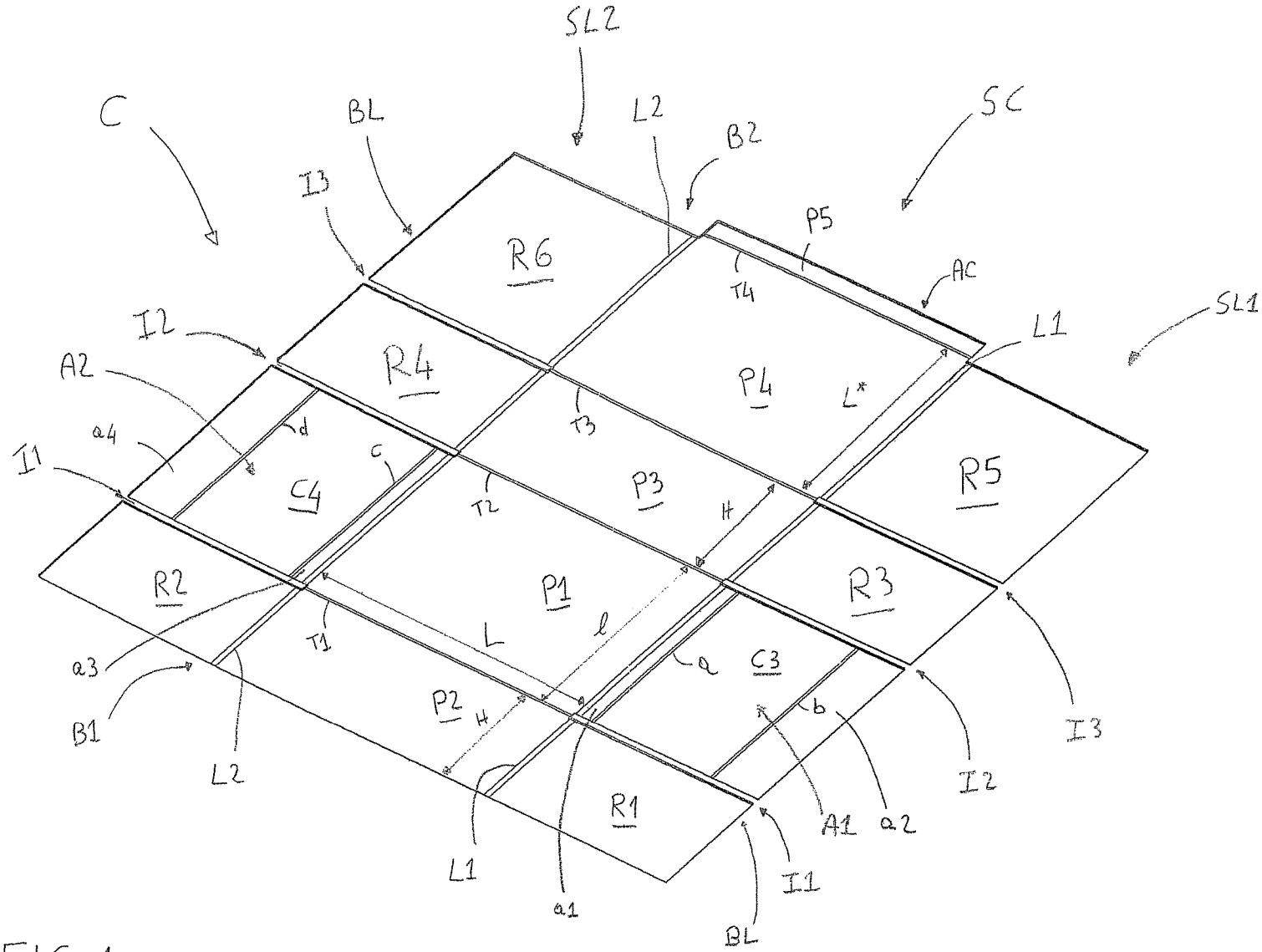
FIG. 1, mentioned in the preamble to the present description, in a perspective view, illustrates the cardboard packaging designed by the Applicant and object of the above-cited Italian patent application, which cardboard blank is obtained from the machine of the invention starting from a cardboard sheet cut from a continuous strip of cardboard and then subjected to successive operations so as to pack an article in a cardboard box obtained from the cardboard blank.

With reference to the appended figures of the drawings, (S1) denotes the cutting station for cutting a cardboard sheet from a continuous strip of cardboard (S) stored in a fanfold, object of the present invention, while reference numeral (100) denotes the machine for packaging an article internally of a cardboard box obtained from the cardboard sheet in its entirety, comprising the cutting station (S1).

Figure 2A:
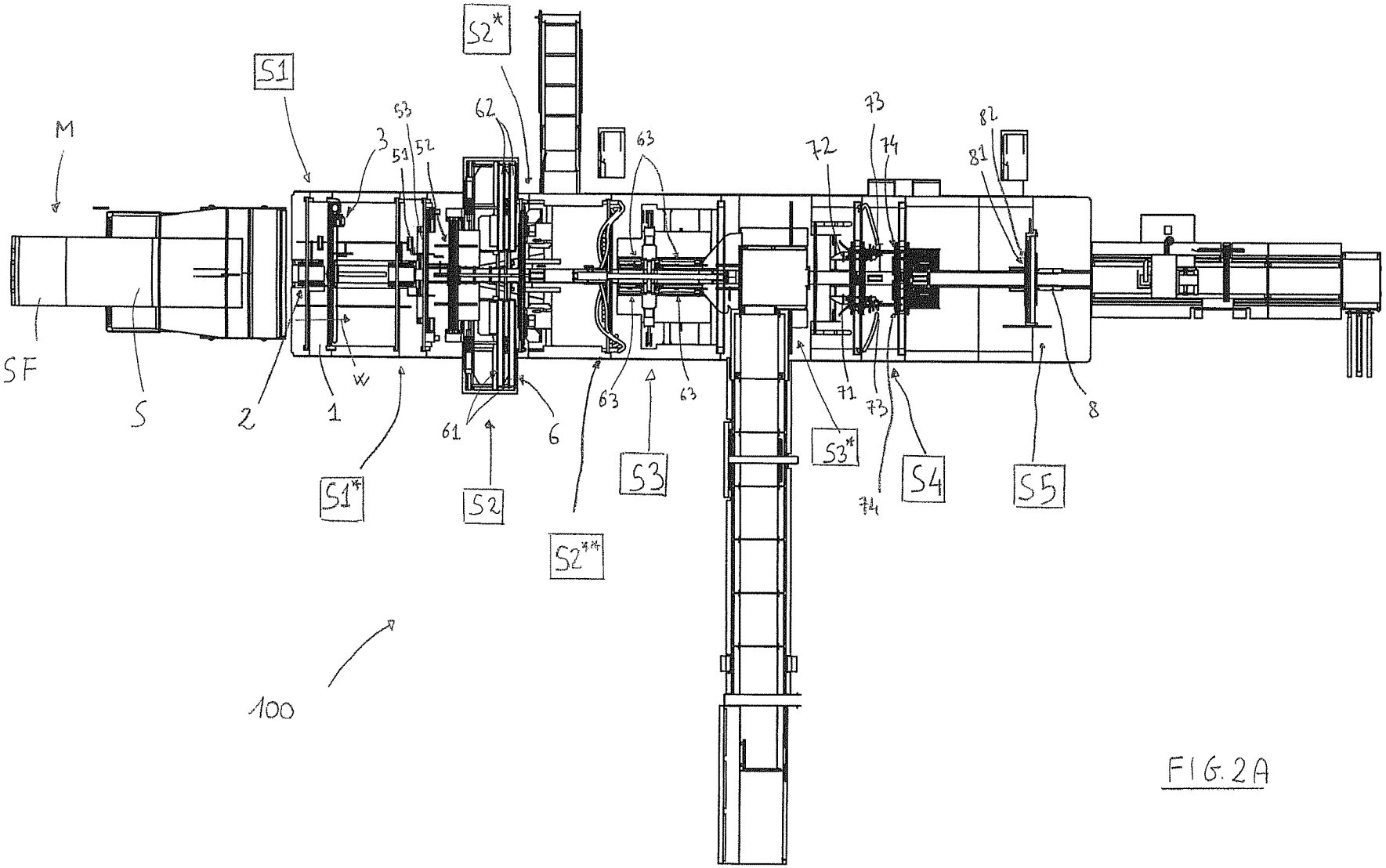
FIG. 2A illustrates, in a schematic view from above of the layout of a machine for packing an article internally of a cardboard box obtained from a cardboard sheet of the present invention.
Figure 2B:
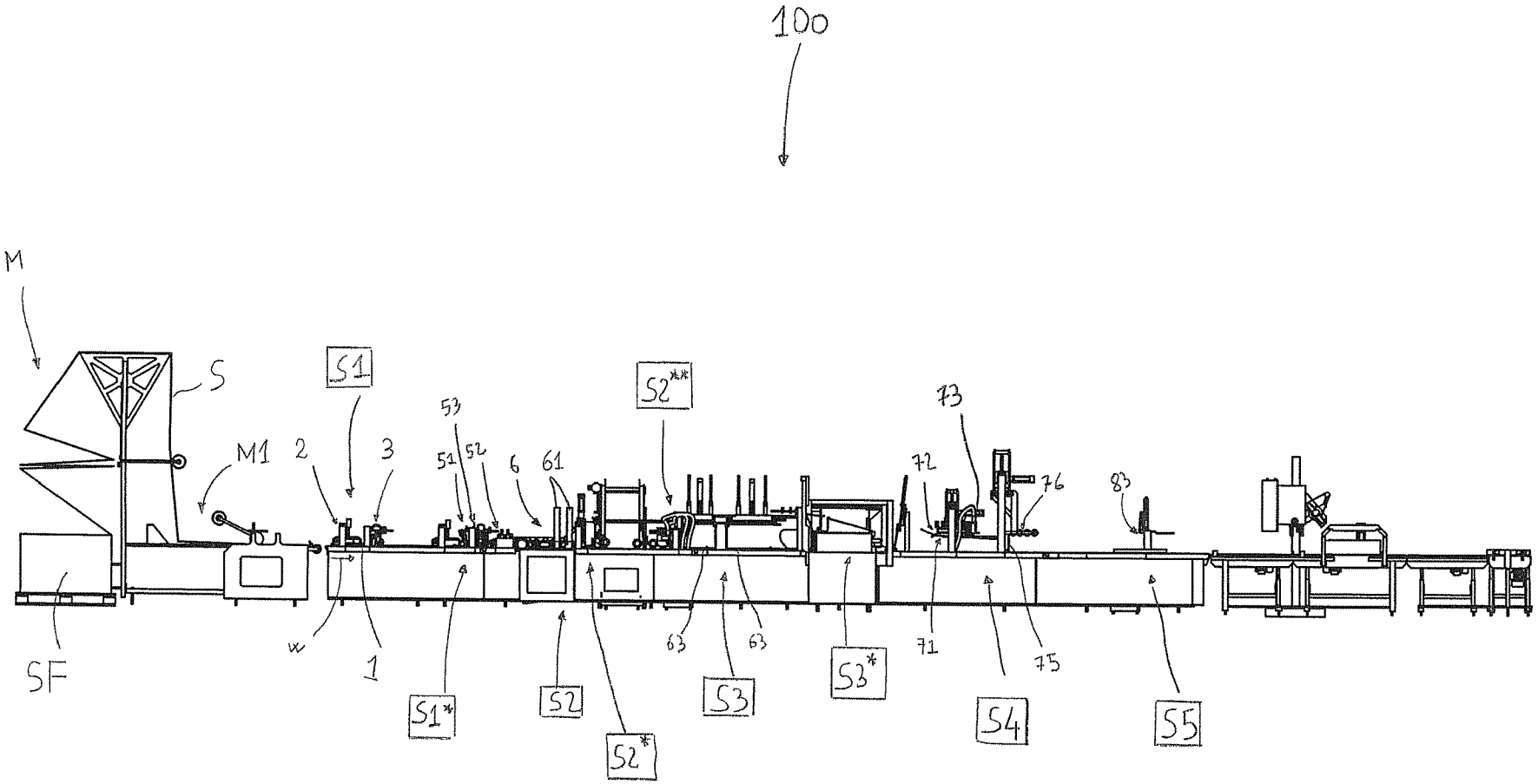
FIG. 2B illustrates the machine of FIG. 2 in a lateral view.

The cutting station (S1) is designed to carry out a cutting of a cardboard sheet (F) from a continuous strip of cardboard (S) folded several times upon itself to form a fanfold (SF) and which is unwound from a fanfold so as to be cut (see for example FIG. 2B on the left).

The cutting station (S1) comprises a conveyor plane (1), predisposed so as to be able to restingly receive the continuous strip of cardboard (S) which is unwound from the fanfold (SF), conveying means (2), for advancing the continuous strip of cardboard (S) along the conveyor plane (1) in an advancement direction (w).

The cutting station (S1) further comprises a cutting group (3), predisposed above the conveyor plane (1), which in turn comprises a first rotary circular blade (31) and a toothed second rotary circular blade (32).

Figure 3B:
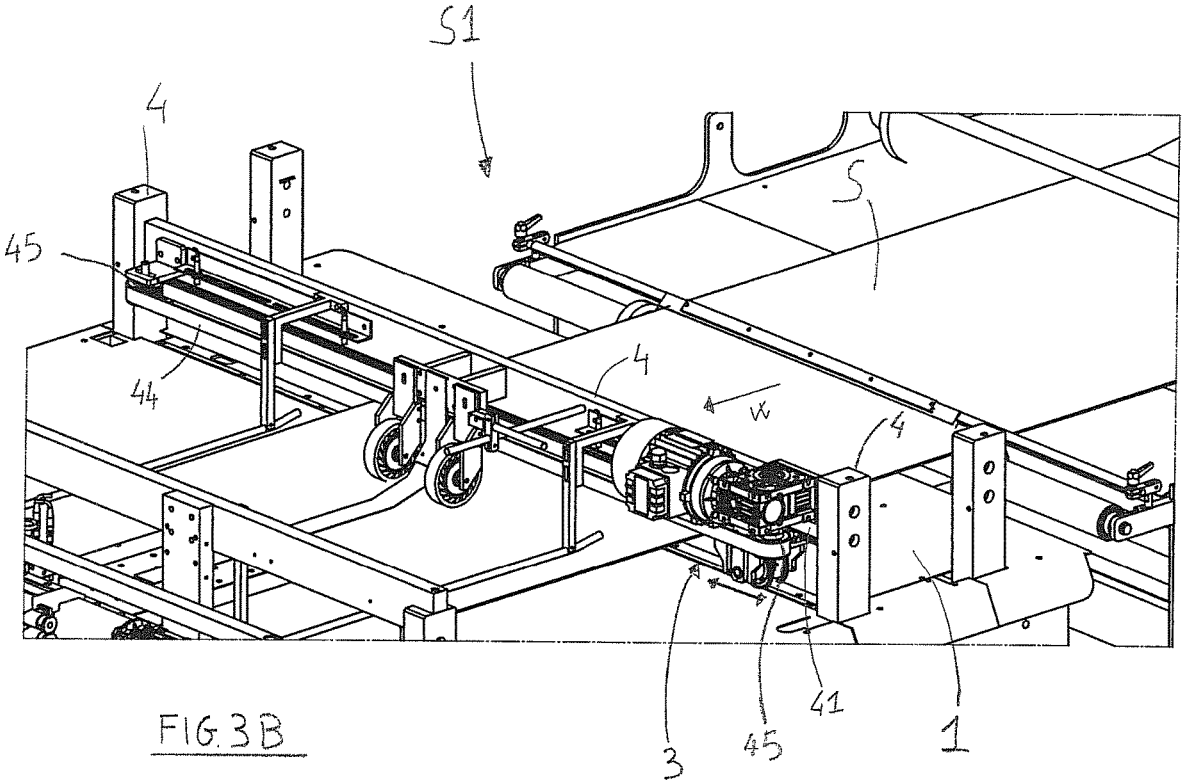
FIG. 3B illustrates, again in a perspective view in a different angle and with some parts removed, the cutting station of the invention.
Figure 3A:
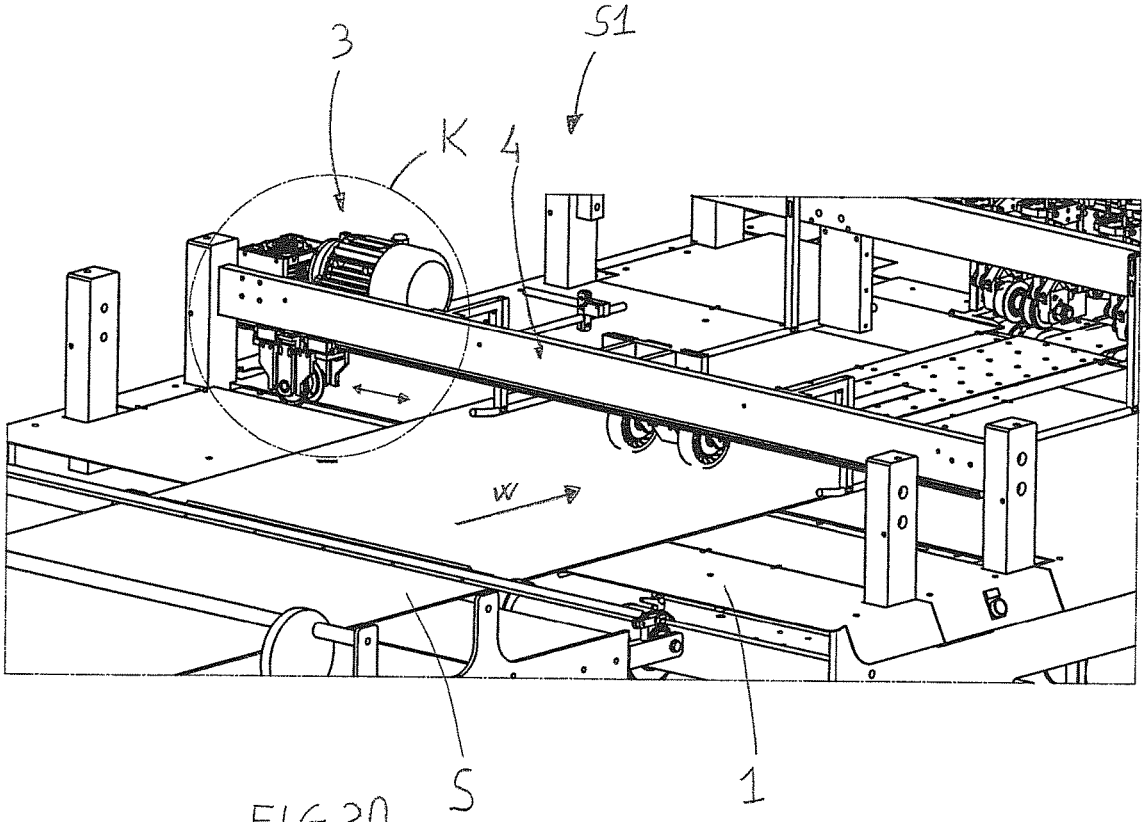
FIG. 3A is a schematic perspective view, with some parts missing, of the cutting station of the present invention for cutting a cardboard sheet from a continuous strip of cardboard folded in a fanfold.
Figure 3C:
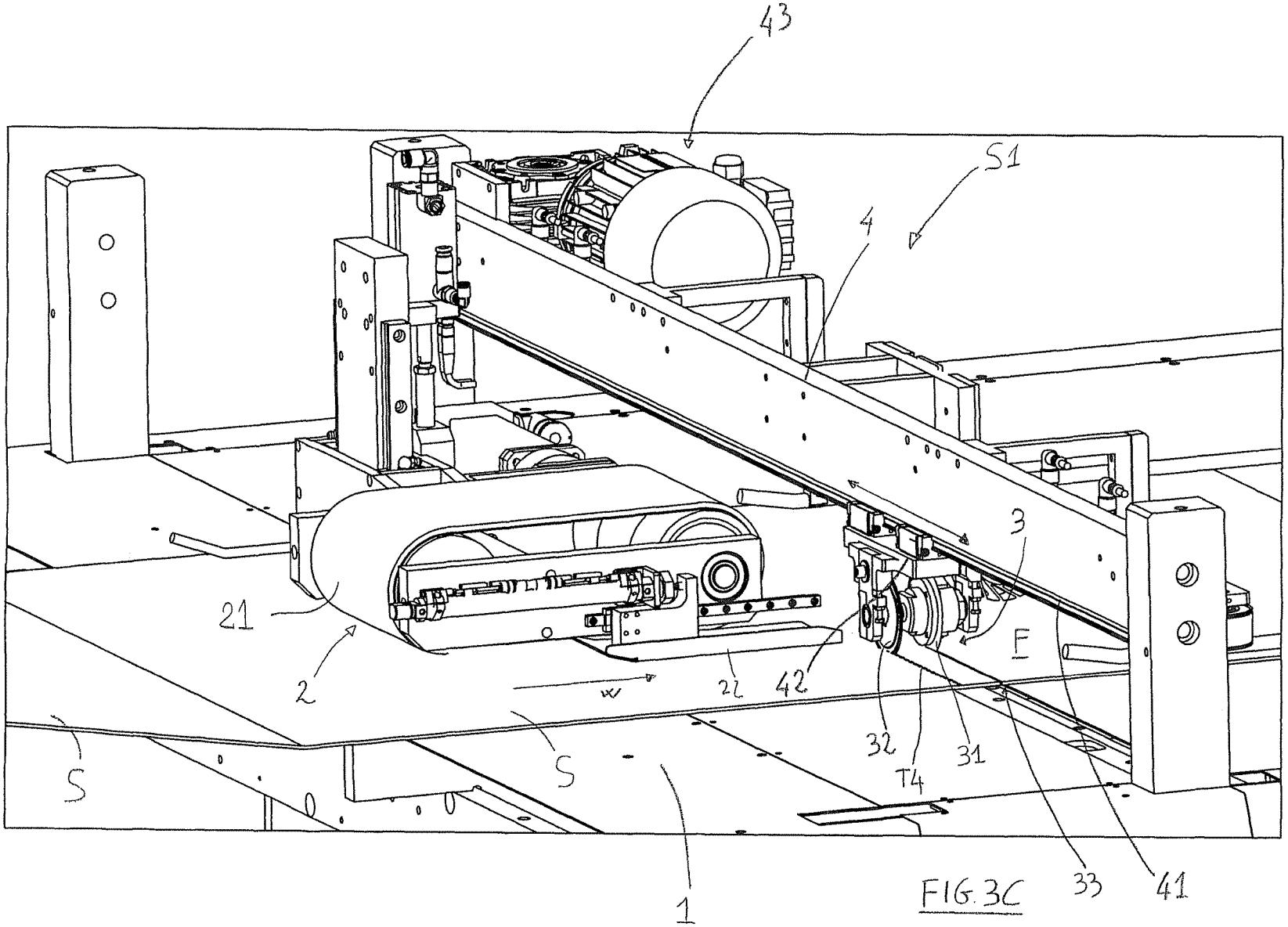
FIG. 3C illustrates, in a schematic perspective view, the cutting station of the present invention in a particular cutting step of a cardboard sheet from a continuous strip of cardboard.
Figure 3D:
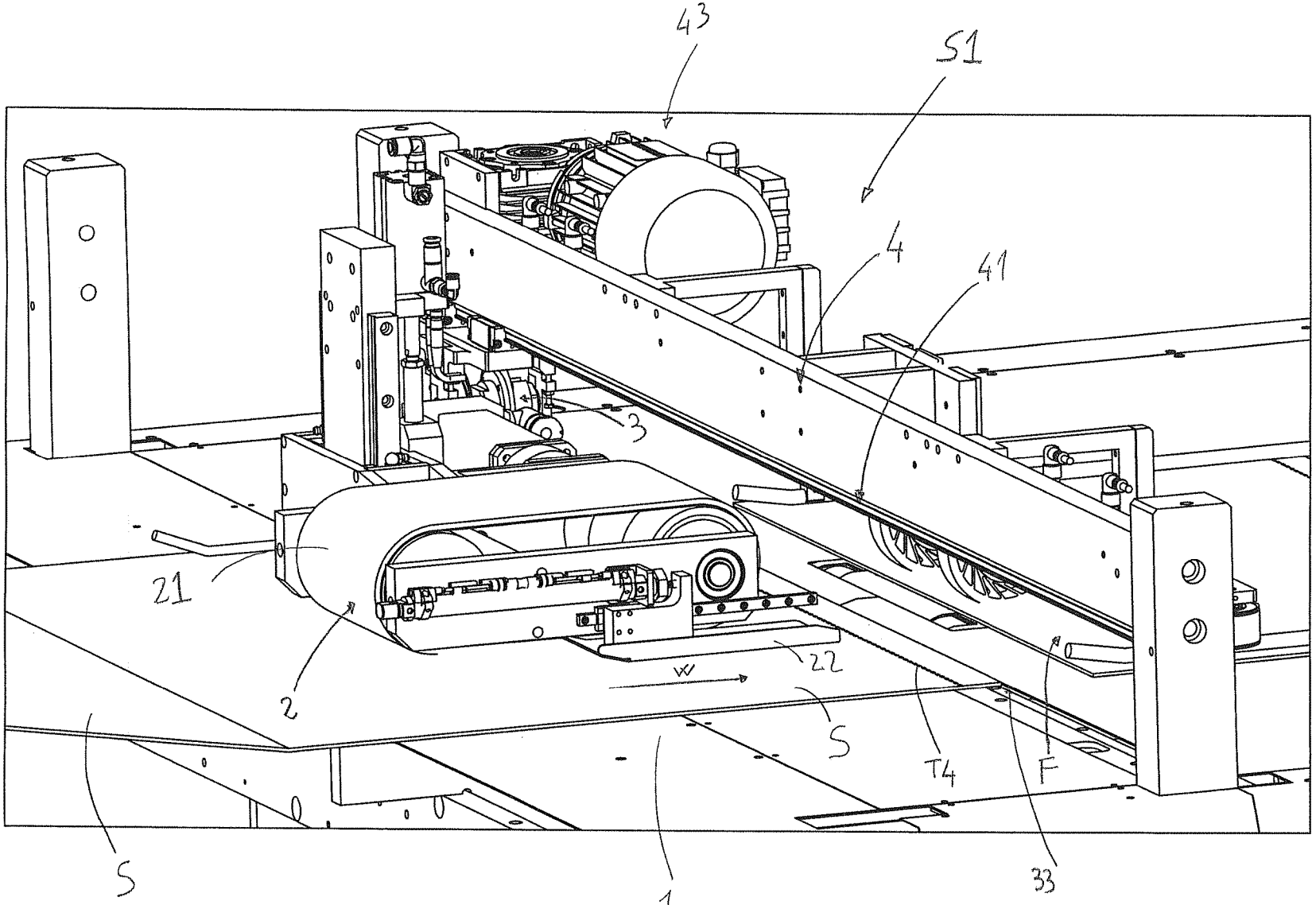
FIG. 3D illustrates, in a perspective view, the cutting station of the present invention, once the cutting operations of a cardboard sheet from the continuous strip of cardboard have been completed.
Figure 3E:
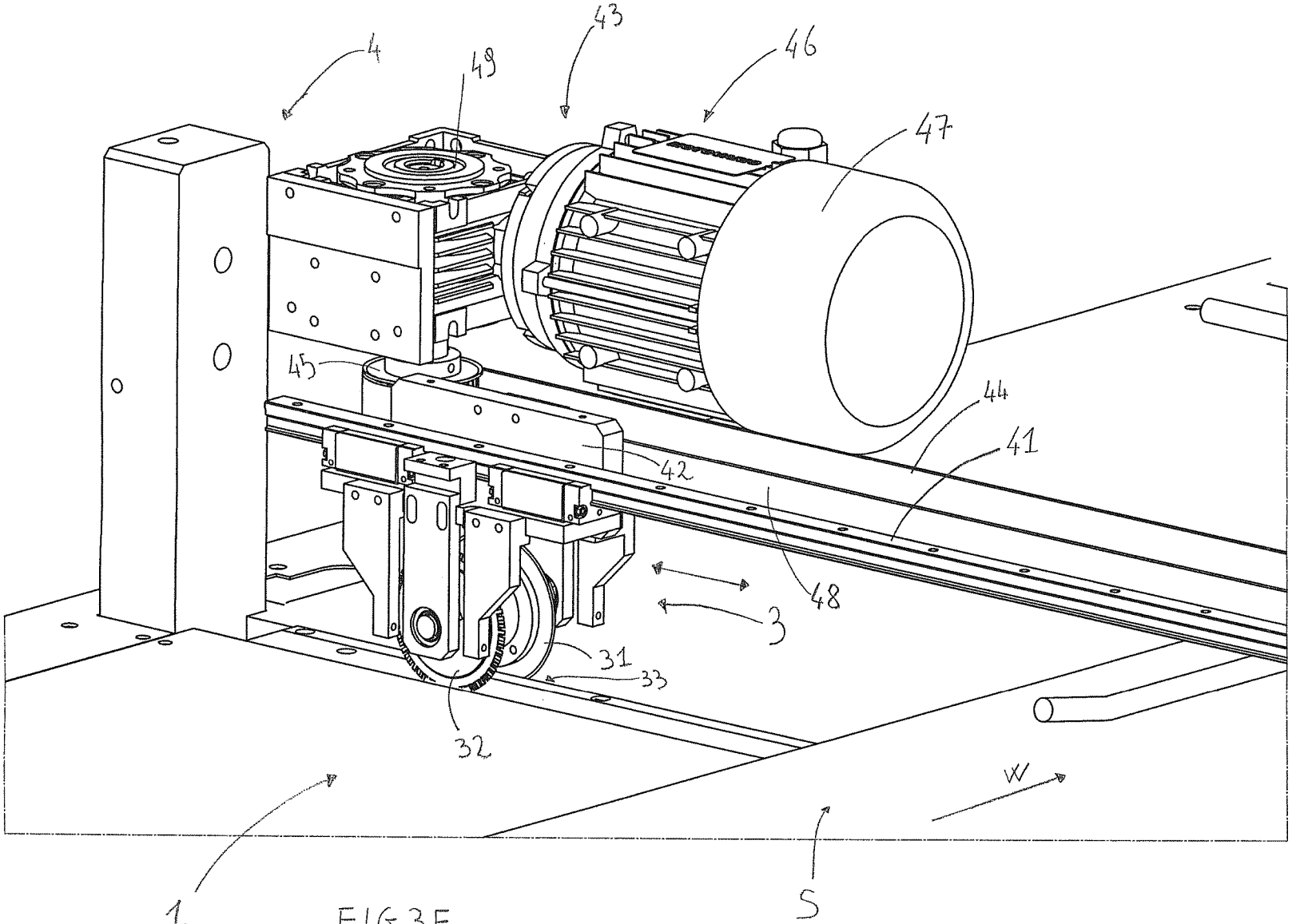
FIG. 3E is a larger-scale view of detail K of FIG. 3A.

In particular, as is clearly visible for example in FIGS. 3C to 3E, the toothed second rotary circular blade (32) is arranged by a flank of and parallel to the first circular blade (31) and upstream of the first rotary circular blade (32) with respect to the advancement direction (w) of the continuous strip of cardboard (S) along the conveyor plane (1).

In greater detail, the first rotary circular blade (31) and the toothed second toothed rotary blade (32) are mounted and predisposed on the cutting group (3) in such a way that a rotation axis thereof is parallel to the advancement direction (w) of the continuous strip of cardboard (S), and therefore the cutting profiles thereof are arranged transversally to the continuous strip of cardboard (S).

The cutting group (3) is mounted above the conveyor plane (1) so as to be movable in alternating translation transversally to the conveyor plane (1) with respect to the advancement direction (w) of the continuous strip of cardboard (S) (see FIGS. 3C and 3D), when the conveying means (2) halt the advancement of the continuous strip of cardboard (S) in a given position along the conveyor plane (1).

The first rotary circular blade (31) is mounted on the cutting group (3) so that the cutting profile thereof passes beyond the conveyor plane (1) at a transversal channel (33) present in the conveyor plane (1), which acts as an abutment for the first rotary circular blade (31), so that it can pass beyond the thickness of the cardboard strip, so as to be able to shear and cut the continuous strip of cardboard (S) and obtain a cardboard sheet (F) (see FIGS. 3C and 3D).

In turn, the toothed second rotary circular blade (32) being mounted on the cutting group (3) so that the cutting profile thereof contacts the continuous strip of cardboard (S) without passing beyond it so as to realise thereon a transversal score line (T4) parallel to the edge cut by the first circular blade (31) on the continuous strip of cardboard (S) (see FIGS. 3C and 3D). The transversal score line (T4) realised in this way will enable a facilitated opening of the box which will be obtained from the cardboard blank as it constitutes a weakened point at the closing tab of the box.

In this way, and advantageously, the cutting group (3), when the conveying means (2) halt the advancing of the cardboard strip (S) on the conveyor plane (1), is alternatively translated transversally to the advancement direction (w) of the continuous strip of cardboard (S), i.e. transversally of the strip of cardboard (S) from one side to another of the conveyor plane.

Therefore, during a first translation of the cutting group (3), the first circular blade (31) of the cutting group (3) shears and cuts a cardboard sheet (F) which cardboard sheet (F) will then be subjected to successive forming steps of the packaging cardboard blank and the folding of the cardboard for packaging of an article internally of a relative cardboard box, and, at the same time, the toothed second rotary circular blade (32) performs, on the advanced part of the continuous strip of cardboard, in proximity of the cut edge, a transversal score line (T4), which will constitute the fourth transversal score line (T4) of the cardboard sheet (FIG. 3D) which will then subsequently be cut from the cardboard sheet (S) during a second translation of the cutting group (3), in an opposite direction to the first translation.

The fact that the cutting group (3) carries out its cutting and realisation operations of the transversal score line (T4) at each translation thereof, transversally from one side to another of the conveyor plane (1), enables obtaining high production velocity, and therefore obtaining a high production frequency of cardboard blanks.

The conveying means (2) are predisposed and configured so as to advance the continuous strip of cardboard (S) along the conveyor plane (1) at different velocities, according to the effective dimensions of the article to be packed, and then halt the strip, so that there is a longer or shorter portion of the strip of cardboard beyond the cutting group (3), so as to be able to obtain a longer or shorter cardboard sheet (F), i.e. having a length that is such as to enable obtaining therefrom of a cardboard blank (C) suitable for enveloping about the article for the formation of the relative packaging box.

Other preferred characteristics of the cutting station (S1) proposed by the present invention are described in the following.

The cutting station (S1) comprises a frame (4) predisposed above the conveyor plane (1), a sliding guide (41) which is mounted on the frame (4), transversally to the conveyor plane (1), for guiding the alternating translation of the cutting group (3) above the conveyor plane (1), and a carriage (42) slidably coupled to the sliding guide (41) on which carriage (42) the cutting group (3) is mounted.

The cutting station (S1) comprises movement means (43), which are predisposed on the frame (4) in such a way as to activate, in alternating translation, the carriage (42) along the sliding guide (41) so that the carriage (42), and therefore the cutting group (3), can be translated from a first side to a second side of the conveyor plane (1) and vice versa, so as to enable the cutting group (3) to carry out the cutting operations on the continuous strip of cardboard (S) at each translation thereof.

The movement means (43) comprise (see in particular FIG. 3B and FIG. 3E): a belt (44) loop-wound on relative pulleys (45) which are arranged with an axis thereof perpendicular to the conveyor plane (1), and which is predisposed on the frame (4) transversally to the conveyor plane (1) and so that a part of a branch (48) thereof is connected and constrained to the carriage (42), and motor means (46) for alternating activation of the loop-wound belt (44) so that the relative branch (48) constrained to the carriage (42) is activated in alternating translation with respect to the conveyor plane (1) for translating the carriage (42) from a first side to a second side of the conveyor plane (1), and vice versa.

For example, the motor means (46) preferably comprise a drive member (47) connected to a pulley (45) on which the loop-wound belt (44) is wound.

The motor means (46) comprise a reducer (49), which is interposed between the drive member (47) and the pulley (45).

The above-mentioned conveying means (2) can, for example as visible in FIG. 3C and FIG. 3D, comprise a conveyor belt (21) that is loop-wound and arranged above the conveyor plane (1) so as to be in contact, with the lower branch thereof, with the continuous strip of cardboard (S) to be advanced along the conveyor plane and abutment means (22) positioned so as to maintain the continuous strip of cardboard (S) resting on and in contact with the conveyor plane (1).

As indicated in the preceding, in FIGS. 2A and 2B, in relative views from above and from the side, a layout of a machine (100) for packaging an article internally of a cardboard box is illustrated, obtained from a cardboard sheet of the present invention, and comprising the cutting station (S1) described in the foregoing.

Figure 2C:
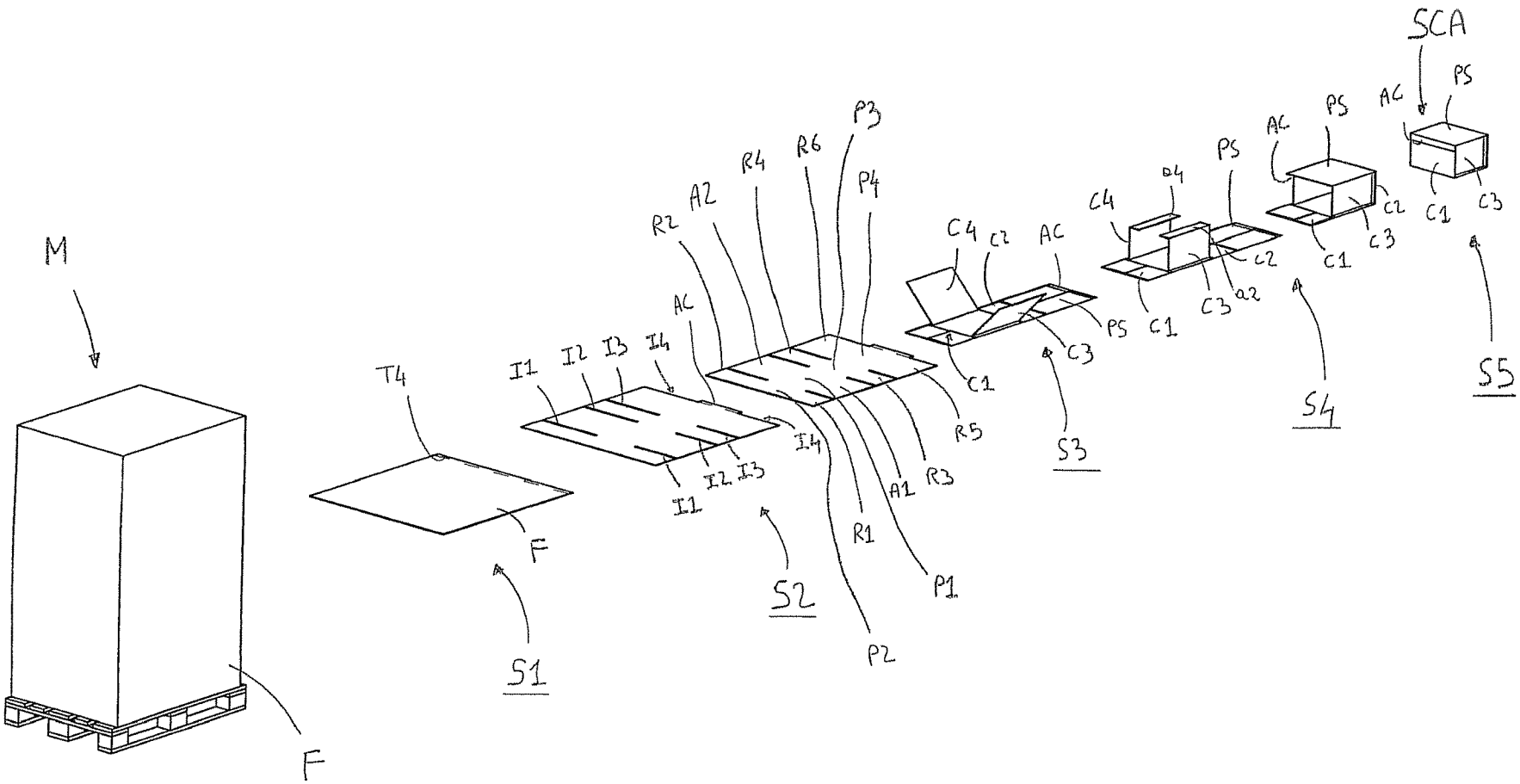
FIG. 2C schematically illustrates, in a succession of images, example embodiments of some main work operations that the packaging machine of the invention carries out starting from a cardboard sheet cut from a continuous strip of cardboard contained in a fanfold, for obtaining first the cardboard blank illustrated in FIG. 1, and then folding the cardboard blank about an article and obtaining a closed cardboard box with the article packaged and closed inside it.
Figure 2D:
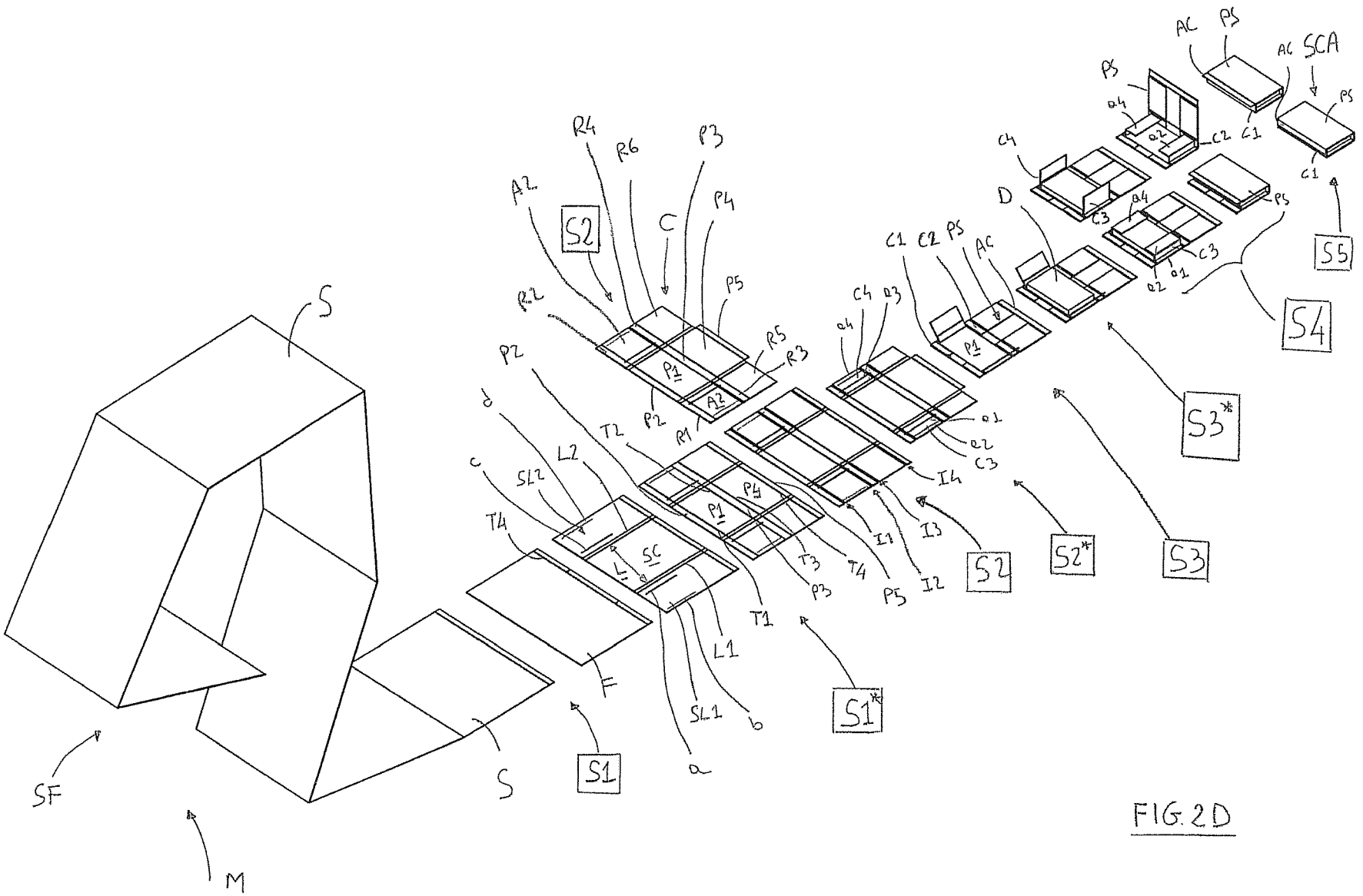
FIG. 2D very schematically illustrates, with a succession of images in perspective view, the operating sequence of the machine of the present invention.

FIG. 2C and FIG. 2D schematically illustrate, in a succession of images, the various operations which the packaging machine carries out starting from obtaining a cardboard sheet cut from a continuous strip of cardboard, processing the cardboard sheet so as to obtain a cardboard blank for packaging, and the operations for wrapping the cardboard blank for packaging about an article and obtaining a closed cardboard box with the packaged article inside it.

In particular, FIG. 2C illustrates, with a series of images, some main operating steps of the machine of the invention, while FIG. 2D illustrates the complete succession of all the operating steps which the machine performs for packaging an article internally of a cardboard box starting from a cardboard sheet cut from a continuous strip of cardboard, which operations include realising, starting from the cut cardboard sheet, a cardboard blank (C) such as the one illustrated in FIG. 1, and folding the cardboard blank about an article so as to package it and close it internally of a cardboard box.

The operating sequences illustrated in the succession of images in FIGS. 2C and 2D have been illustrated with reference to the packaging of two articles of different shapes and dimensions, and therefore both the cardboard blanks and the final boxes obtained in the two cases have a different shape and dimension.

This is also for demonstrating how the machine (100) of the present invention is able to package and close articles internally of the relative cardboard boxes independently of the dimensions of the articles, i.e. the machine (100) realises the cardboard for packaging on the basis of the effective dimensions of the articles so that the blanks can be folded about the articles and obtain the relative boxes with the packaged and packed articles internally of the boxes.

The machine (100) comprises:

- a store (M) in which a continuous strip of cardboard (S) is predisposed, folded in bellows fashion on itself to form a fanfold (SF);
- a cutting station (S1) of a cardboard sheet (F) from the continuous strip of cardboard (S), which cutting station (S1) is situated downstream of the store (M), realised as described in the foregoing, wherein the continuous strip of cardboard (S) unwound from the fanfold (SF) is fed and advanced in an advancement direction (w) and cut so as to obtain a cardboard sheet (F) and wherein at the same time a transversal score line (T4) is realised, parallel to the cut edge on the continuous strip of cardboard (S);
- a score line forming station (S1*), downstream of the cutting station (S1), into which the cut cardboard sheet (F) coming from the cutting station (S1) is fed, and on which the cardboard sheet (F) the two longitudinal score lines (L1, L2) are realised, so as to identify, in the cardboard sheet (F), a central sector (SC) and two lateral sectors (SL1, SL2); and three transversal score lines (T1, T2, T3), for identifying, in the central sector (SC), five portions (P1, P2, P3, P4, P5), and wherein in the portion of cardboard sheet of the two lateral sectors (SL1, SL2), two pairs of longitudinal fold lines (a, b) (c, d) are made at the flanks of the first portion (P1), which identify the first (a1), second (a2), third (a3) and fourth (a4) folding tabs of the two lateral folding flaps (A1, A2) from which the third (C3) and the fourth (C4) lateral closing walls of the cardboard box are obtained.

In the score line forming station (S1*), the longitudinal score lines (L1, L2) and the transversal score lines (T1, T2, T3) are realised as a function of the effective dimensions of the article to be packed, in particular as a function of the dimensions of the base of the article (width L, length I) and of the height (H) of the flanks of the article.

In particular, for example, the two longitudinal score lines (L1, L2) at a mutual distance that is equal to the length (L) of the base of the article, the first transversal score line (T1) is made at a distance from a first transversal edge (B1) of the cardboard sheet (upstream edge with respect to the infeed direction into the score line forming station) corresponding to the height (H) of a first flank of the article, the second transversal score line (T2) is made at a distance from the first transversal score line (T1) on the basis of the width (I) of the base of the article, the third transversal score line (T3) is made at a distance from the second score line (T2) corresponding to the height (H) of a second flank of the article, opposite the first flank, and at a distance from a fourth transversal score line (T4), corresponding to the score line (T4) which had previously been realised in the cutting station (S1), corresponding to the width (L*) of the upper face of the article.

In this regard, the score line forming station (S1*) comprises (FIGS. 2A, 2B):

first score line forming means (51) predisposed to realise, on the cardboard sheet (F), the two longitudinal score lines (L1, L2) parallel to the advancement direction and parallel to the longitudinal edges (BL) of the cardboard sheet (F), distanced from one another by a distance corresponding to a length (L) of the base of the article to be packed, so as to identify, in the cardboard sheet (F), a central sector (SC) and two lateral sectors (SL1, SL2) (see for example the third image starting from the left in FIG. 2D);

second score line forming means (52) that are predisposed for realising the three transversal score lines (T1, T2, T3) in the central sector (SC) parallel to one another and distanced so as to identify, in the central sector (SC), the above-mentioned five portions (P1, P2, P3, P4, P5) in the following way (see FIG. 1 and the fourth image starting from the left in FIG. 2D).

A first portion (P1), between the first transversal score line (T1) and the second transversal score line (T2) having dimensions corresponding to the base of the article to be packed;

a second portion (P2), between a first transversal edge (B1) of the cardboard sheet (F) and the first transversal score line (T1), having dimensions corresponding to a first flank of the article;

a third portion (P3), adjacent to the first portion (P1), between the second transversal score line (T2) and the third transversal score line (T3) having dimensions corresponding to a second flank of the article, opposite the first flank;

a fourth portion (P4), between the third score line (T3) and a fourth score line (T4) corresponding to the score line (T4) which has been made in the cutting station (S1), having dimensions corresponding to the upper face of the article;

and a fifth portion (P5) constituted by a strip of material of the cardboard sheet beyond the fourth transversal score line (T4), having a width equal to a distance between the first rotary circular blade (31) and the toothed second rotary circular blade (32) of the cutting station (S1).

In particular, the second score line forming means (52) are predisposed for realising the three transversal score lines (T1, T2, T3) from a longitudinal edge (BL) to the other longitudinal edge (BL) of the cardboard sheet (F), so that the transversal score lines also involve the two lateral sectors (SL1, SL2) of the cardboard sheet (F).

The score line forming station (S1*) lastly further comprises third score line forming means (53) which are predisposed so as to realise, in the portions of the cardboard sheet (F) of the two lateral sectors (SL1, SL2), at flanks of the first portion (P1), pairs of longitudinal folding lines (a, b), (c, d) parallel to the two score lines (L1, L2) and having a same width extension as the first portion (P1).

The machine further comprises a transversal cutting station (S2), downstream of the score line forming station (S1*), into which the cardboard sheet (F) is fed in an advancement direction with the longitudinal score lines (L1, L2) and transversal score lines (T1, T2, T3, T4) and the pairs of folding lines (a, b), (c, d), and at which for each of the two lateral sectors (SL1, SL2) four transversal cuts are made on the cardboard sheet.

Three transversal cuts (I1, I2, I3) are made at the first three transversal score lines (T1, T2, T3), for obtaining the various reinforcing flaps (R1, R2, R3, R4, R5, R6) and the two lateral enveloping flaps (A1, A2), and a fourth transversal cut (I4) is realised in the strip of material so as to leave one only central portion in the strip of material, projecting from the fourth transversal score line (T4), which will identify the fifth portion (P5) of the cardboard blank for packing, and which will constitute the closing tab (AC) of the cardboard box (see for example the third image starting from the left in FIG. 2C and the pair of fifth images starting from the left in FIG. 2D).

The transversal cutting station (S2) will provide, at the outlet thereof, a cardboard blank for packaging (C) such as the one illustrated in the foregoing and illustrated in FIG. 1, that is, with the five portions (P1, P2, P3, P4, P5) in the central sector (SC), the six reinforcing flaps (R1, R2, R3, R4, R5, R6) in the two lateral sectors (SL1, SL2), and the two lateral enveloping flaps (A1, A2) (see also FIGS. 2C and 2D).

In this regard, for this purpose, the transversal cutting station (S2) comprises (see FIGS. 2A, 2B): cutting means (6), for example constituted by two opposite pairs of rotary die cutters (61, 62) which are predisposed and activatable for carrying out, during the advancement of the cardboard sheet (F), four transversal cuts (I1, I2, I3, I4) for each of the two lateral sectors (SL1, SL2) of the cardboard sheet (F), so as to realise three transversal cuts (I1, I2, I3), starting from the longitudinal edges (BL) of the cardboard sheet (F) up to arriving at the two longitudinal score lines (L1, L2), at the first three transversal score lines (T1, T2, T3), and a fourth transversal cut (I4) in the strip of material comprised between the fourth transversal score line (T4) and the advanced transversal edge (B2) of the cardboard sheet (F), so as to narrow the width of the fifth portion (P5), projecting from the fourth transversal score line (T4), (see FIGS. 2C and 2D).

In this way, due to the realising of these cuts, the following are obtained:

at the two ends of the second portion (P2), a first reinforcing flap (R1) and a second reinforcing flap (R2);

at the two ends of the first portion (P1), a first lateral enveloping flap (A1), containing the first pair of longitudinal folding lines (a, b) which identify a first folding tab (a1), between the first folding line (a) and the first longitudinal score line (L1), and a second folding tab (a2) between the folding line (b) and the edge of the first enveloping flap (A1), and a second lateral enveloping flap (A2), containing the second pair of longitudinal folding lines (c, d) which identify a third folding tab (a3), between the folding line (c) and the second longitudinal score line (L2) and a fourth folding tab (a4) between the folding line (d) and the edge of the second enveloping flap (A2);

at the two ends of the third portion (P3), a third reinforcing flap (R3) and a fourth reinforcing flap (R4);

at the two ends of the fourth portion (P4), a fifth reinforcing flap (R5) and a sixth reinforcing flap (R6);

and forming, in the strip of cut material of the fifth portion (P5), a tab (AC) for closing the cardboard box.

As previously mentioned, the transversal cutting station (S2) provides in outlet a cardboard blank for packing (C) with the characteristics illustrated in FIG. 1: downstream of this transversal cutting station (S2), the machine (100) further comprises a successive series of work stations for carrying out the operations on the cardboard blank (C) that are necessary for realising the packing of the article internally of a box obtained from the cardboard blank.

In detail, downstream of the transversal cutting station (S2), the machine (100) comprises, in succession one after another: a first folding station (S3), a feeding station (S3*) of the article to be packed, a second folding station (S4), for the partial folding of the cardboard blank about the article, and a closing station (S5) for the final folding of the cardboard blank about the article so as to obtain a closed cardboard box with the article inside, completely packed and packaged (see FIGS. 2A, 2B).

The first folding station (S3) is arranged downstream of the transversal cutting station (S2), into which the cardboard blank (C) is fed in an advancement direction and in which the cardboard blank (C) is halted and, simultaneously, i.e. in a single operation:

the first (R1) and second reinforcing flap (R2) are folded, with respect to the first (LI) and the second (L2) longitudinal score line, on the second portion (P2) of the central sector (SC), for obtaining the first lateral closing wall (C1);

the third (R3) and fourth reinforcing flap (R4), with respect to the first (L1) and the second (L2) longitudinal score line, on the third portion (P3) of the central sector (SC), for obtaining a second lateral closing wall (C2);

the fifth (R5) and sixth reinforcing flap (R6), with respect to the first (L1) and the second (L2) longitudinal score line, on the fourth portion (P4) of the central sector (SC), for obtaining an upper closing wall (PS);

the first folding tab (a1) of the first lateral enveloping flap (A1), with respect to the first longitudinal score line (L1), for superposing a part of the first portion (P1) of the central sector (SC) and forming a reinforcing edge and defining a third lateral closing wall (C3), the third folding tab (a3) of the second lateral enveloping flap (A2) is folded with respect to the second longitudinal score line (L2), for superposing on a part of the first portion (P1) of the central sector (SC) and forming a reinforcing edge and defining a fourth lateral closing wall (C4)

Figure 1A:
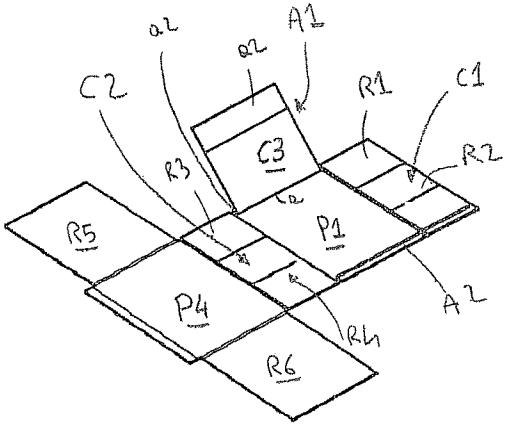
FIGS. 1A to 1F illustrate, according to respective perspective views, possible folding steps of the cardboard blank of FIG. 1 so as to enable packaging an article and obtaining a closed cardboard box with the article inside.

(see FIG. 1A, the fifth image from the left in FIG. 2C and the seventh image from the left in FIG. 2D).

As mentioned, these folding operations are carried out with the cardboard blank and simultaneously with one another, i.e. in a single action, therefore very rapidly and swiftly, required truly short pause times for the cardboard blank.

In this regard, the machine (100), in the first folding station (S3), comprises first folding means (63) for folding simultaneously: the first (R1) and second flap (R2), with respect to the first (L1) and the second (L2) longitudinal score line, on the second portion (P2) of the central sector (SC), for obtaining a first lateral closing wall (C1); the third (R3) and fourth reinforcing flap (R4), with respect to the first (L1) and the second (L2) longitudinal score line, on the third portion (P3) of the central sector (SC), for obtaining a second lateral closing wall (C2); the fifth (R5) and sixth flap (R6), with respect to the first (L1) and the second (L2) longitudinal score line, on the fourth portion (P4) of the central sector (SC), for obtaining an upper closing wall (PS); the first folding tab (a1) of the first lateral enveloping flap (A1), with respect to the first longitudinal score line (L1), for superposing a part of the first portion (P1) of the central sector (SC) and forming a reinforcing edge and defining a third lateral closing wall (C3), and the third folding tab (a3) of the second lateral enveloping flap (A2), with respect to the second longitudinal score line (L2), for superposing on a part of the first portion (P1) of the central sector (SC) and forming a reinforcing edge and defining a fourth lateral closing wall (C4).

Figure 1B:
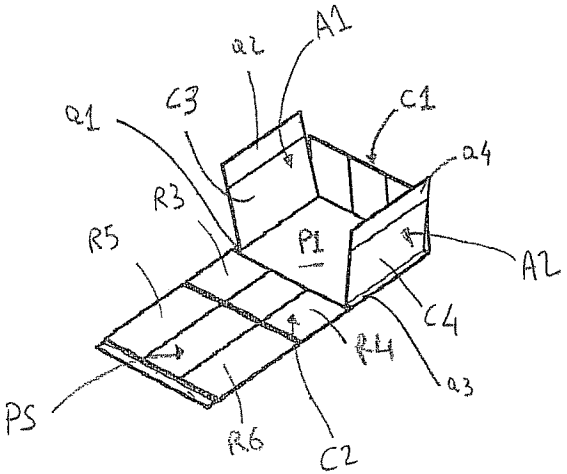
Figure 1C:
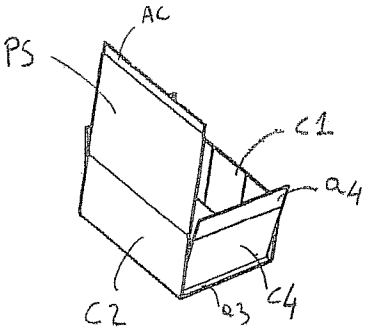
Figure 1D:
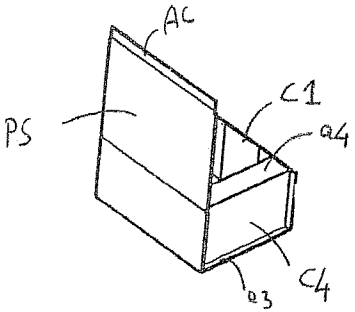
Figure 1E:
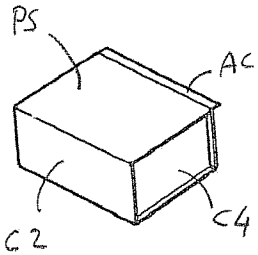
Figure 1F:
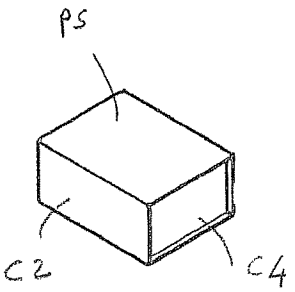

At the outlet of the first folding station (S3), the cardboard blank (C) has, formed upon it, the first lateral closing wall (C1), the second lateral closing wall (C2), the upper closing wall (PS), which all have a reinforced structure thanks to the reinforcing flaps folded and partially superposed on one another, and which are on the same plane as the first portion (P1) of the cardboard blank, while the third (C3) and fourth (C4) lateral closing wall are already partially erected and folded with respect to the central portion (P1) following the bending of the first folding tab (a1) and third folding tab (a3) above the first portion (P1), with the cardboard blank having the shape illustrated in the fifth image from the left in FIG. 2C, and also illustrated in FIG. 1B).

Downstream of this first folding station (S3), the machine (100) comprises a feeding station (S3*) of an article to be packed (see FIGS. 2A, 2B and 2D), wherein an article to be packed is deposited and rested on the first portion (P1) of the cardboard blank (C), with a first flank facing towards the first lateral closing wall (C1), a second flank, opposite the first, facing towards the second lateral closing wall (C2), a third flank, transversal to the first two, facing towards the third lateral closing wall (C3), and a fourth flank, opposite the third, facing towards the fourth lateral closing wall (C4).

At this point, the machine (100) further comprises, downstream of the inserting station of the article (S3*), a second folding station (S4) to which the cardboard blank (C) with the article rested thereon, on the first portion (P1) thereof, is fed and advanced in an advancement direction.

In the second folding station (S4), the cardboard blank (C) is advanced in the advancement direction, and while the cardboard blank (C) is in motion, at the same time (see for example the third-last image of FIG. 2C, or the pair of the flanked two third-last images of FIG. 2D):

the third lateral closing wall (C3) is folded with respect to the score line (a) which separates it from the first folding tab (a1) so as to cover the third flank of the article, and the second folding tab (a2) is folded with respect to the score line (b) which separates it from the third lateral closing wall (C3), so as to superpose it on a part of the upper face of the article, and the fourth lateral closing wall (C4) is folded with respect to the score line (c) which separates it from the third folding tab (a3) so as to cover the fourth flank of the article, and the fourth folding tab (a4) is folded with respect to the score line (d) which separates it from the fourth lateral closing wall (C4), so as to superpose it on a part of the upper face of the article.

These folding operations, as mentioned, are carried out by advancing the cardboard blank along an advancement direction, and as soon as these folding operations have been completed, the machine (100) applies glue on the second (a2) and fourth (a4) folding tabs folded onto the upper face of the article.

The machine (100) also includes, again in the second folding station (S4), and once the glue has been applied, halting the cardboard blank and (see for example the penultimate image of FIG. 2 or the pair of the two penultimate images of FIG. 2D):

rotating the second lateral closing wall (C2), with respect to the second transversal score line (T2), so as to fold it with respect to the first portion (P1) on which the article (for example folded by 90°) is rested up to when it goes to cover the second flank of the article.

and then, in sequence, rotating the upper closing wall (PS), with respect to the third transversal score line (T3), so as to fold it with respect to the second lateral closing wall (C2) (for example folded by 90°) up to when it goes to cover the upper face of the article.

For this purpose, the machine (100) comprises, in this second folding station (S3) (see FIGS. 2A, 2B):

second folding means (71) for rotating the third lateral closing wall (C3), with respect to the fold line (a) which separates it from the first folding tab (a1), and folding the third lateral closing wall (C3) up to when it goes to cover the third flank of the article, and for rotating the second folding tab (a2), with respect to the score line (b) which separates it from the third lateral closing wall (C3), and folding the second folding tab (a2) up to superposing it on a part of the upper face of the article;

third folding means (72) for rotating the fourth lateral closing wall (C4), with respect to the score line (c) which separates it from the third folding tab (a3), and folding the fourth lateral closing wall (C4) up to when it goes to cover the fourth flank of the article, and for rotating the fourth folding tab (a4), with respect to the score line (d) which separates it from the fourth lateral closing wall (C4), so as to fold the fourth folding tab (a4) up to superposing it on a part of the upper face of the article;

means for applying glue (73) predisposed for applying glue on the second (a2) and fourth (a4) folding tab folded onto the upper face of the article;

blocking means (74), for blocking and halting the cardboard blank (C) once the means for applying glue (74) have applied the glue;

and fourth folding means (75) for rotating the second lateral closing wall (C2), with respect to the second transversal score line (T2), so as to fold it with respect to the first portion (P1) on which the article is rested up to when it goes to cover the second flank of the article, and fifth folding means (76) for rotating, in succession, following the folding of the second lateral closing wall (C2), the upper closing wall (PS) with respect to the third transversal score line (T3), so as to fold it with respect to the second lateral closing wall (C2) up to when it goes to cover the upper face of the article, and therefore provide in outlet from the second folding station (S4) a cardboard box (SCA) partially closed with the packed article internally thereof.

At this point, the article is almost completely enveloped in the folded cardboard blank and the packing is almost concluded.

The machine (100), therefore, transfers the cardboard blank (C), partly folded about the article in the above-described way, at the final closing station (S5), situated downstream of the second folding station (S4), at which the cardboard blank is halted, the first lateral closing wall (C1) is rotated with respect to the first transversal score line (T1) and folded with respect to the first portion (P1) (for example by 90°) so that it goes to cover the first flank of the article; at the same time as the bending of the first lateral closing wall (C1), glue is applied on the upper part of the first lateral closing wall (C1) (see the image on the left of the pair of last two images of FIG. 2D).

Lastly, following the completion of these operations, the machine (100), while still keeping the cardboard blank stationary in the final closing station (S5), rotates the closing tab (AC) with respect to the fourth transversal score line (T4), and folds the closing tab (AC) with respect to the upper wall (PS) (for example by 90°) against the upper part of the first lateral closing wall (C1), to make it adhere thereto and complete the closure of the cardboard box with the packaged article, internally thereof (see the last image of FIG. 2C and the image on the right of the pair of two further images of FIG. 2D).

For this purpose, the machine (100), in this final closing station (S5), comprises (see FIGS. 2A, 2B):

stop means (8) activatable for halting the cardboard box (SCA);

sixth folding means (81) predisposed for being activated once the box (SCA) has been halted for rotating the first lateral closing wall (C1), with respect to the first transversal score line (T1), so as to fold it with respect to the first portion (P1) on which the article is rested so that it goes to cover the first flank of the article;

a glue applying organ (82), functionally associated to the sixth folding means (81), and predisposed for applying glue on a part of the first lateral closing wall (C1) while it is folded by the sixth folding means (81) against the first flank of the article, and seventh folding means (83) activatable for rotating the closing tab (AC) with respect to the fourth transversal score line (T4), and folding the closing tab (AC) with respect to the upper wall (PS) against the upper part of the first lateral closing wall (C1) on which the glue had been applied, in order to make it adhere thereto and complete the closing of the cardboard box (SCA) with the article packed internally thereof, and thus provide at the outlet of the final closing station (S5) a cardboard box (SCA) completely closed with the packed article internal thereof.

The machine (100) then transfers the cardboard box, with the packaged article inside, to the outlet of the final closing station (S5), so that the cardboard box can be collected and directed towards a station for management and dispatch of orders.

The machine (100), further comprises, between the transversal cutting station (S2) and the first folding station (S3), also a trimming station (S2*), in which the cardboard blank can be trimmed along the longitudinal edges so as to adapt the length of the reinforcing flaps (R1, R2, R3, R4, R5, R6) to the effective dimensions of the second (P2), third (P3) and fourth portion (P4), so that the reinforcing flaps can effectively be folded above the portions, and at least partially superposed on one another, so as to adapt the length of the two lateral folding flaps (A1, A2), to the effective dimension of the third flank and fourth flank of the article.

The machine (100) also comprises, again between the transversal cutting station (S2) and the first folding station (S3), downstream of the trimming station (S2*), a glue applying station (S2) comprising means for applying glue at least on reinforcing flaps (R1, R2, R3, R4, R5, R6) and/or on the second portion (P2), third portion (P3) and fourth portion (P4), on which the reinforcing flaps (R1, R2, R3, R4, R5, R6) have to be folded in the following first folding station (S3**).

The invention claimed is:

1. A machine for packing an article internally of a cardboard box obtained from a cardboard sheet, comprising:

a store in which a continuous strip of cardboard is predisposed, folded on itself to form a fanfold; and a cutting station for cutting a cardboard sheet from the continuous strip of cardboard, the cutting station being situated downstream of the store and comprising:

a conveyor plane, predisposed so as to be able to restingly receive the continuous strip of cardboard which is unwound from the fanfold, conveying means, for advancing the continuous strip of cardboard along the conveyor plane in an advancement direction and for halting the continuous strip of cardboard for enabling cutting thereof; and a cutting group, predisposed above the conveyor plane, and comprising a first rotary circular blade and a toothed second rotary circular blade, arranged by a flank of and parallel to the first rotary circular blade, and upstream of the first rotary circular blade with respect to the advancement direction of the continuous strip of cardboard along the conveyor plane, the first rotary circular blade and the toothed second rotary blade being mounted and predisposed on the cutting group in such a way that a rotation axis thereof is parallel to the advancement direction of the continuous strip of cardboard, and therefore cutting profiles thereof are arranged transversally to the continuous strip of cardboard, the cutting group being mounted above the conveyor plane so as to be movable in alternating translation transversally to the conveyor plane with respect to the advancement direction of the continuous strip of cardboard, when the conveying means halt the strip of cardboard along the conveyor plane, the first rotary circular blade being mounted on the cutting group so that the cutting profile thereof passes beyond the conveyor plane at a transversal channel present in the conveyor plane so as to be able to trim and cut the continuous strip of cardboard and obtain a cardboard sheet, the second toothed circular blade being mounted on the cutting group so that the cutting profile thereof contacts the continuous strip of cardboard without passing beyond it so as to realise thereon a transversal score line parallel to the edge cut by the first circular blade on the continuous strip of cardboard, wherein the continuous strip of cardboard unwound from the fanfold by means of an unwinding device is fed and advanced in an advancement direction and cut so as to obtain a cardboard sheet and wherein at the same time a transversal score line is realised, parallel to the cut edge on the continuous strip of cardboard, the machine further comprising a score line forming station, downstream of the cutting station, into which the cut cardboard sheet is fed, coming from the cutting station, and advanced in an advancement direction, the score line forming station comprising:

first score line forming means predisposed to realise, on the cardboard sheet, two longitudinal score lines parallel to the advancement direction and parallel to the longitudinal edges of the cardboard sheet, distanced from one another by a distance corresponding to a length of the base of the article to be packed, so as to identify, in the cardboard sheet, a central sector and two lateral sectors;

second score line forming means that are predisposed for realising three transversal score lines parallel to one another, and parallel to the score line previously realised, and distanced so as to identify, in the central sector, together with a fourth score line, constituted by the score line previously realised in the cut station, five portions: a first portion, between the first transversal score line and the second transversal score line having dimensions corresponding to the base of the article to be packed; a second portion, between a first transversal edge of the cardboard sheet and the first transversal score line, having dimensions corresponding to a first flank of the article; a third portion, adjacent to the first portion, between the second transversal score line and the third transversal score line having dimensions corresponding to a second flank of the article, opposite the first flank; a fourth portion, between the third score line and the fourth transversal score line, having dimensions corresponding to the upper face of the article; and a fifth portion constituted by a strip of material of the cardboard sheet beyond the fourth transversal score line, having a width equal to a distance between the first rotary circular blade and the toothed second rotary circular blade of the cutting station; and third score line forming means which are predisposed so as to realise, in the portions of the cardboard sheet of the two lateral sectors, at flanks of the first portion, pairs of longitudinal folding lines parallel to the two score lines and having a same width extension as the first portion, the machine further comprising a transversal cutting station, downstream of the score line forming station, into which the cardboard sheet is fed in an advancement direction with the longitudinal score lines and transversal score lines and the pairs of folding lines, the transversal cutting station comprising cutting means which are predisposed and activatable for carrying out, during the advancement of the cardboard sheet, four transversal cuts for each of the two lateral sectors of the cardboard sheet, so as to realise three transversal cuts, starting from the longitudinal edges of the cardboard sheet up to arriving at the two longitudinal score lines, at the first three transversal score lines, and a fourth transversal cut in the strip of material comprised between the fourth transversal score line and the advanced transversal edge of the cardboard sheet, so as to narrow the width of the fifth portion, projecting from the fourth transversal score line, in order to obtain: at the two ends of the second portion, a first reinforcing flap and a second reinforcing flap; at the two ends of the first portion, a first lateral enveloping flap, containing the first pair of longitudinal folding lines which identify a first folding tab between the folding line and the first longitudinal score line, and a second folding tab between the folding line and the edge of the first enveloping flap, and a second lateral enveloping flap, containing the second pair of longitudinal folding lines which identify a third folding tab, between the folding line and the second longitudinal score line and a fourth folding tab between the folding line and the edge of the second enveloping flap; at the two ends of the third portion, a third reinforcing flap and a fourth reinforcing flap; at the two ends of the fourth portion, a fifth reinforcing flap and a sixth reinforcing flap; and forming, in the strip of cut material of the fifth portion, a tab for closing the cardboard box, so as to provide, at the outlet of the transversal cutting station, a cardboard blank for packing an article;

the machine further comprising a first folding station, downstream of the transversal cutting station, into which the cardboard blank is fed in an advancement direction and in which the cardboard blank is halted, and comprising first folding means for folding simultaneously: the first and second flap, with respect to the first and the second longitudinal score line, on the second portion of the central sector, for obtaining a first lateral closing wall; the third and fourth flap, with respect to the first and the second longitudinal score line, on the third portion of the central sector, for obtaining a second lateral closing wall; the fifth and sixth flap, with respect to the first and the second longitudinal score line, on the fourth portion of the central sector, for obtaining an upper closing wall; the first folding tab of the first lateral enveloping flap, with respect to the first longitudinal score line, for superposing a part of the first portion of the central sector and forming a reinforcing edge and defining a third lateral closing wall, and the third folding tab of the second lateral enveloping flap, with respect to the second longitudinal score line, for superposing a part of the first portion of the central sector and forming a reinforcing edge and defining a fourth lateral closing wall, the machine further comprising a feeding station of an article to be packed, to which the cardboard blank coming from the first folding station is fed and wherein an article to be packed is deposited and rested on the first portion of the cardboard blank, with a first flank facing towards the first lateral closing wall, a second flank, opposite the first, facing towards the second lateral closing wall, a third flank, transversal to the first two, facing towards the third lateral closing wall, and a fourth flank, opposite the third, facing towards the fourth lateral closing wall;

the machine further comprising a second folding station to which the cardboard blank with the article rested thereon, on the first portion thereof, is fed and advanced in an advancement direction, the second folding station comprising:

second folding means for rotating the third lateral closing wall, with respect to the folding line which separates it from the first folding tab, and folding the third lateral closing wall up to when it goes to cover the third flank of the article, and for rotating the second folding tab, with respect to the folding line which separates it from the third lateral closing wall, and folding the second folding tab up to superposing it on a part of the upper face of the article;

third folding means for rotating the fourth lateral closing wall, with respect to the folding line which separates it from the third folding tab, and folding the fourth lateral closing wall up to when it goes to cover the fourth flank of the article, and for rotating the fourth folding tab, with respect to the folding line which separates it from the fourth lateral closing wall, so as to fold the fourth folding tab up to superposing it on a part of the upper face of the article;

means for applying glue predisposed for applying glue on the second and fourth folding tab folded onto the upper face of the article;

blocking means, for blocking and halting the cardboard blank once the means for applying glue have applied the glue;

fourth folding means for rotating the second lateral closing wall, with respect to the second transversal score line, so as to fold it with respect to the first portion on which the article is rested up to when it goes to cover the second flank of the article, and fifth folding means for rotating, in succession, the upper closing wall with respect to the third transversal score line, so as to fold it with respect to the second lateral closing wall up to when it goes to cover the upper face of the article, and therefore provide in outlet from the second folding station a cardboard box partially closed with the packed article internally thereof;

the machine further comprising a final closing station, situated downstream of the second folding station, to which the partially-closed cardboard box is fed, the final closing station comprising:

stop means activatable for halting the cardboard box;

sixth folding means predisposed for being activated once the box has been halted for rotating the first lateral closing wall, with respect to the first transversal score line, so as to fold it with respect to the first portion on which the article is rested so that it goes to cover the first flank of the article;

a glue applying organ, functionally associated to the sixth folding means, and predisposed for applying glue on a part of the first lateral closing wall while it is folded by the sixth folding means against the first flank of the article, and seventh folding means activatable for rotating the closing tab with respect to the fourth transversal score line, and folding the closing tab with respect to the upper wall against the upper part of the first lateral closing wall on which the glue had been applied, in order to make it adhere thereto and complete the closing of the cardboard box with the article packed internally thereof, in order to provide at the outlet of the final closing station a cardboard box completely closed with the packed article internal thereof.

2. The machine of claim 1, further comprising a frame predisposed above the conveyor plane, a sliding guide mounted on the frame, transversally to the conveyor plane, for guiding the alternating translation of the cutting group above the conveyor plane, and in that it comprises a carriage slidably coupled to the sliding guide on which carriage the cutting group is mounted.

3. The machine of claim 2, further comprising movement means, predisposed on the frame in such a way as to activate, in alternating translation, the carriage along the sliding guide so that the carriage, and therefore the cutting group, can be translated from a first side to a second side of the conveyor plane and vice versa, so as to enable the cutting group to carry out the cutting operations on the continuous strip of cardboard at each translation thereof.

4. The machine of claim 3, wherein the movement means comprise a belt loop-wound on relative pulleys which are arranged with an axis thereof perpendicular to the conveyor plane and predisposed on the frame transversally to the conveyor plane and so that a part of a branch thereof is connected and constrained to the carriage, and motor means for alternative activation of the loop-wound belt so that the relative branch constrained to the carriage is activated in alternating translation with respect to the conveyor plane for translating the carriage from a first side to a second side of the conveyor plane, and vice versa.

5. The machine of claim 4, wherein the motor means comprise a drive member connected to a pulley on which the loop-wound belt is wound.

6. The machine of claim 5, wherein the motor means comprise a reducer interposed between the drive member and the pulley.

* * * * *